US007373717B2

(12) United States Patent
Lee et al.

(10) Patent No.: US 7,373,717 B2
(45) Date of Patent: May 20, 2008

(54) METHOD OF MANUFACTURING A SELF-SUSTAINING CENTER-ANCHOR MICROELECTROMECHANICAL SWITCH

(75) Inventors: Jae Woo Lee, Daejeon-Shi (KR); Sung Weon Kang, Daejeon-Shi (KR); Youn Tae Kim, Daejeon-Shi (KR)

(73) Assignee: Electronics and Telecommunications Research Institute, Daejon-shi (KR)

( * ) Notice: Subject to any disclaimer, the term of this patent is extended or adjusted under 35 U.S.C. 154(b) by 0 days.

(21) Appl. No.: 11/636,449

(22) Filed: Dec. 11, 2006

(65) Prior Publication Data

US 2007/0080765 A1 Apr. 12, 2007

Related U.S. Application Data

(62) Division of application No. 10/800,767, filed on Mar. 16, 2004, now Pat. No. 7,170,374.

(51) Int. Cl.
*H01H 11/00* (2006.01)
*H01H 65/00* (2006.01)

(52) U.S. Cl. ..... 29/622; 29/825; 29/846; 29/874; 29/876; 200/181; 335/78; 335/262

(58) Field of Classification Search ..... 29/622, 29/825, 846, 874, 876; 200/181; 335/78, 335/262

See application file for complete search history.

(56) References Cited

U.S. PATENT DOCUMENTS 5,578,976 A 11/1996 Yao
6,069,540 A * 5/2000 Berenz et al. ..... 333/101
6,307,169 B1 10/2001 Sun et al.
6,777,629 B2 * 8/2004 Lane et al. ..... 200/181

FOREIGN PATENT DOCUMENTS

KR 1020010010224 2/2001
KR 1020020085988 11/2002

OTHER PUBLICATIONS

Muldavin et al.; "High-Isolation CPW MEMS Shunt Switches—Part 1: Modeling"; IEEE; vol. 48, No. 6; Jun. 2000; pp. 1045-1052.

Tan et al.; "A DC-Contact MEMS Shunt Switch"; IEEE; vol. 12, No. 6; Jun. 2002, pp. 212-214.

* cited by examiner

*Primary Examiner*—Tim Phan
(74) *Attorney, Agent, or Firm*—Lowe Hauptman Ham & Berner LLP

(57) ABSTRACT

Provided is a manufacturing method of self-sustaining center-anchor microelectromechanical switch driven by an electrostatic force used for controlling a signal transmission in an electronic system, which can suppress deformation of a movement plane generated during manufacturing and operation process by inserting the self-sustaining center-anchor, and improve a ground line contact phenomenon of an upper electrode, thereby enhancing reliability and signal isolation feature while maintaining an existing insertion loss feature compared to the microelectromechanical switch of the prior art.

9 Claims, 9 Drawing Sheets

METHOD OF MANUFACTURING A SELF-SUSTAINING CENTER-ANCHOR MICROELECTROMECHANICAL SWITCH

CROSS REFERENCE TO RELATED APPLICATION

This application is a divisional of U.S. Ser. No. 10/800,767, filed on Mar. 16, 2004 now U.S. Pat. No. 7,170,374. This application, in its entirety, is incorporated herein by reference.

BACKGROUND

1. Field of the Invention

The present invention relates to a self-sustaining center-anchor microelectromechanical switch and a method of manufacturing the same and, more particularly, to a self-sustaining center-anchor microelectromechanical switch that driven by an electrostatic force used for controlling a RF signal in an electronic system for high frequency.

2. Discussion of Related Art

In order to control a signal in an electronic system with a high frequency bandwidth, an easily integratable semiconductor switch, such as a field effect transistor (FET) or a p-I-n diode, has been used, but since each semiconductor has problems, such as a high insertion loss, a low isolation loss, and a signal distortion, a research on the microelectromechanical switch has widely been progressed.

Generally, the microelectromechanical switch comprises a movement element that moves relative to a substrate, and a driving element that drives the movement element. The driving element has two electrodes that are located facing each other, and the movement element is configured to move in a horizontal direction or in a vertical direction to the substrate, or to rotate within a predetermined range of angle with respect to the substrate, and thus the movement element is driven according to the electrostatic force generated by the voltage applied to the driving element to perform a switching operation.

FIG. 1A is a plan view for illustrating an example of a cantilever type microelectromechanical switch of the prior art, and FIG. 1B is a cross-sectional view taken along line A1-A2 in the microelectromechanical switch of FIG. 1A. The cantilever type microelectromechanical switch of the prior art is disclosed in U.S. Pat. No. 5,578,976.

A lower electrode 2 and a signal line 3 are formed on a substrate 1, and a cantilever arm 5 supported by a anchor unit 4 fixed to the substrate is located over the lower electrode 2 and the signal line 3. An upper electrode 6 is formed on the cantilever arm 5, and at the lower of the end portion of the cantilever arm 5, a contact unit 7 is formed for connecting a disconnected portion of the signal line. In the cantilever arm 5 and the upper electrode 6, an intermediate portion is formed narrower than other portions, so that the end portion of the cantilever arm 5 has a constant elasticity.

When a predetermined driving voltage is applied to the upper electrode 6 and the lower electrode 2, the cantilever arm 5 is bended downward due to the electrostatic force generated in the portion of a capacitor structure 8 where the upper electrode 6 and the lower electrode 2 are overlapped with each other, and accordingly, the contact unit 7 connects the disconnected portion of the signal line 3 to perform a switching operation.

FIGS. 2A and 2B are cross-sectional views illustrating an operational state of a cantilever type microelectromechanical switch of the prior art.

The microelectromechanical switch shown in FIG. 1A operates in a single pole double throw (SPDT) scheme. In this microelectromechanical switch, since the signal line 3 and the contact unit 7, respectively connected to an input portion and an output portion, are placed perpendicular to each other and the cantilever arm 5 is supported at one side portion only, when the cantilever arm 5 or the upper electrode 6 is deformed due to thermal expansion during the manufacturing or operation process, the contact between the signal line 3 and the contact unit 7 becomes unstable since the switch cannot move in a vertical direction as shown in FIG. 2A, instead it moves in a bended state as shown in FIG. 2B. This contact degradation increases a contact resistance of the signal line 3 and causes a signal delivery to be unstable, thus reducing the reliability.

FIG. 3 is a perspective view for illustrating an example of a membrane type microelectromechanical switch of the prior art. This membrane type microelectromechanical switch according to the prior art is disclosed in Korean Patent Publication No. 10-0339394.

Two ground planes 41 are formed on a substrate 40 with a predetermined distance apart from each other, two lower electrodes 42 used for a signal line are formed between the ground planes 41. Hinges 44, 45 supported to have a constant elasticity by an anchor 43 are connected to each ground plane 41, and over the lower electrode 42, an upper electrode 46 is located. The upper electrode 46 is connected to be movable upward and downward by the hinge 44 and 45.

When driving voltages are applied to the lower electrode 42 and the ground plane 41, respectively, the upper electrode 46 moves downward by the electrostatic force generated between the lower electrode 42 and the upper electrode 46, and accordingly, lower electrode 42 is connected with each other through the upper electrode 46, to perform a switching operation.

In the membrane type microelectromechanical switch of FIG. 3, the upper electrode 46 serving as a movement plane moves downward by the electrostatic force with the ground plane 41 to connect the lower electrode 42 used for the signal line. Therefore, when the surface of the upper electrode 46 made of a metal during manufacturing process or operation process is deformed by thermal expansion, a problem occurs that the movement plane does not completely contact with the signal line so as to permanently remain open, and stiction occurs between the upper electrode 46 and the lower electrode 42 sustained in a narrow gap, thus reducing the stability and reliability of the switch.

A drawback of this membrane type microelectromechanical switch is the deformation of a membrane and the stiction problem. If the movement plane and the hinges are deformed by the thermal expansion, they cannot move in parallel with the substrate when the movement plane moves by the electrostatic force. This is caused by the fact that since the anchor is fixed to the substrate whose thermal expansion ratio is extremely smaller than the movement plane and the hinge, the movement plane and the hinge are greatly thermal-expanded, while the distance between anchors is not changed. Stress is generated by the thermal expansion in a connection portion between the movement plane and the hinge, in which a permanent deformation is taken place. Consequently, owing to the deformation of the movement plate, problems occur that a normal switching operation cannot be performed when the movement plane becomes abnormally apart from the substrate or is tilted toward one side, and when the movement plane is collapsed near the substrate, that the contact portion of the movement plane permanently contacts with the signal line.

Further, the gap between both electrodes for generating the electrostatic force maintains as close as several micrometers, so that the stiction problem that the driving element adheres to other fixing elements is easy to generate, which acts as significant drawbacks in the operation and reliability of the switch.

As illustrated above, since the conventional microelectromechanical switch is configured in the cantilever type or the membrane type, it has structural problems, such as the thermal deformation and stiction. Such problems have a significant influence on the reliability and the signal isolation feature of the microelectromechanical switch used for improving high insertion loss, low signal isolation, signal distortion, etc.

SUMMARY OF THE INVENTION

The present invention is directed to addressing thermal deformation and stiction problems that occur in the cantilever and membrane structural types of the switch.

Further, the present invention is directed to a microelectromechanical switch that is inserted with a self-sustaining center-anchor to suppress deformation of a movement plane generated during manufacturing and operation process, and to improve the ground line contact phenomenon of an upper electrode, leading to the improvement of reliability, and to improve a signal isolation feature while maintaining an existing feature of insertion loss since a signal line gap is much larger than that of the microelectromechanical switch.

Further, the present invention is directed to a self-sustaining center-anchor microelectromechanical switch in which the structural feature of cantilever and membrane types is revised, and a method of the same.

Further, the present invention is directed to a microelectromechanical switch less sensitive to thermal deformation generated during manufacturing and operation process, and having an improved membrane stiction problem to perform a stable operation, and the signal isolation feature is excellent since a signal line gap is relatively large, leading to high yield in manufacturing.

Further, the present invention is directed to a method of manufacturing the foregoing switch.

According to an aspect of the present invention, there is provided a microelectromechanical switch comprising transmission lines formed on a substrate at a predetermined gap and having an input portion and an output portion; ground lines formed at both sides of the transmission lines; a dielectric-moving plate formed on the substrate and including a switch unit that electrically connects the transmission lines during short-circuit operation; an anchor having a self-sustaining center-anchor formed on the center of the transmission lines to support the dielectric-moving plate to the substrate; and upper electrodes located in an upper portion of the dielectric-moving plate and serving as a driving electrode to the ground line, wherein the switching unit is operated by a bending of the dielectric-moving plate generated by a voltage difference applied to the upper electrode and the ground line, and switches the transmission lines.

According to another aspect of the present invention, there is provided a method of manufacturing a self-sustaining center-anchor microelectromechanical switch, the method comprising the steps of: after forming a thin film on a substrate with an insulating material, patterning the thin film using a predetermined mask; forming transmission lines and ground lines in the patterned portion; depositing and patterning a sacrificial layer on the transmission lines and the ground lines to form anchors including a self-sustaining center-anchor; forming on the sacrificial layer a switching unit made of a metal that electrically connects the transmission lines during short-circuit operation; forming a dielectric-moving plate that allows the transmission lines and the ground lines to maintain a constant gap by the anchors to the switching unit and an upper electrode; forming the upper electrodes that act as a driving electrode to the ground line on the dielectric-moving plate; and removing the sacrificial layer formed between the dielectric-moving plate and the transmission line.

Preferably, a space forming an open circuit of the transmission line is configured to have a large one to improve the signal isolation feature in the open state of the switch.

DETAILED DESCRIPTION OF PREFERRED EMBODIMENTS

The present invention will now be described more fully hereinafter with reference to the accompanying drawings.

Figure 1A:
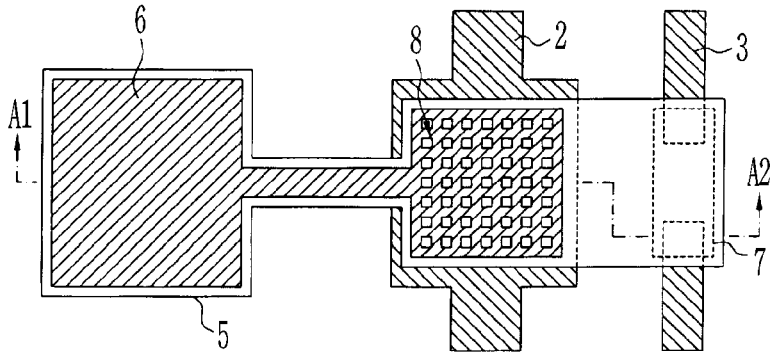
FIG. 1A (PRIOR ART)
FIG. 1A is plan view for illustrating an example of a cantilever type microelectromechanical switch of the prior art.
Figure 1B:
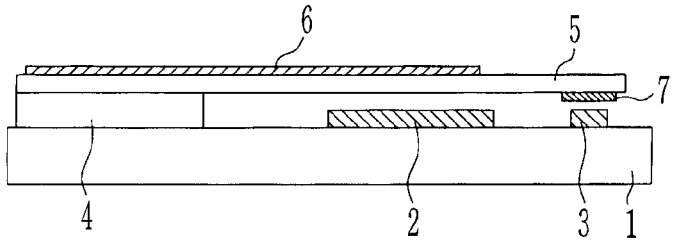
FIG. 1B (PRIOR ART)
FIG. 1B is a cross-sectional view taken along line A1-A2 in the micro electromechanical switch of FIG. 1A.
Figure 2A:
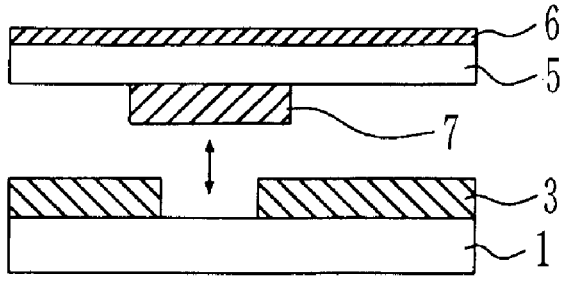
FIG. 2A (PRIOR ART)
FIGS. 2A and 2B are cross-sectional views showing an operational state of a cantilever type microelectromechanical switch of the prior art.
Figure 2B:
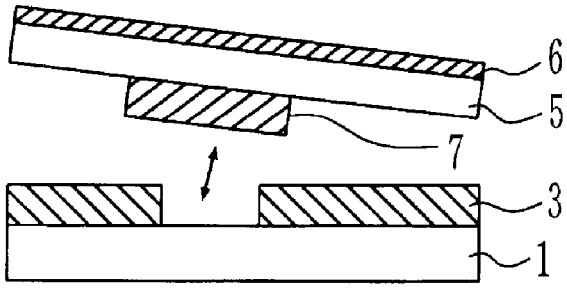
FIG. 2B (PRIOR ART)
Figure 3:
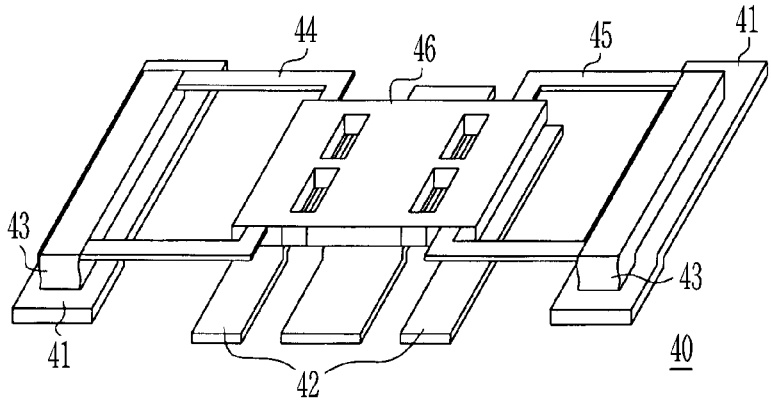
FIG. 3 (PRIOR ART)
FIG. 3 is a perspective view for illustrating an example of a membrane type microelectromechanical switch of the prior art.
Figure 4:
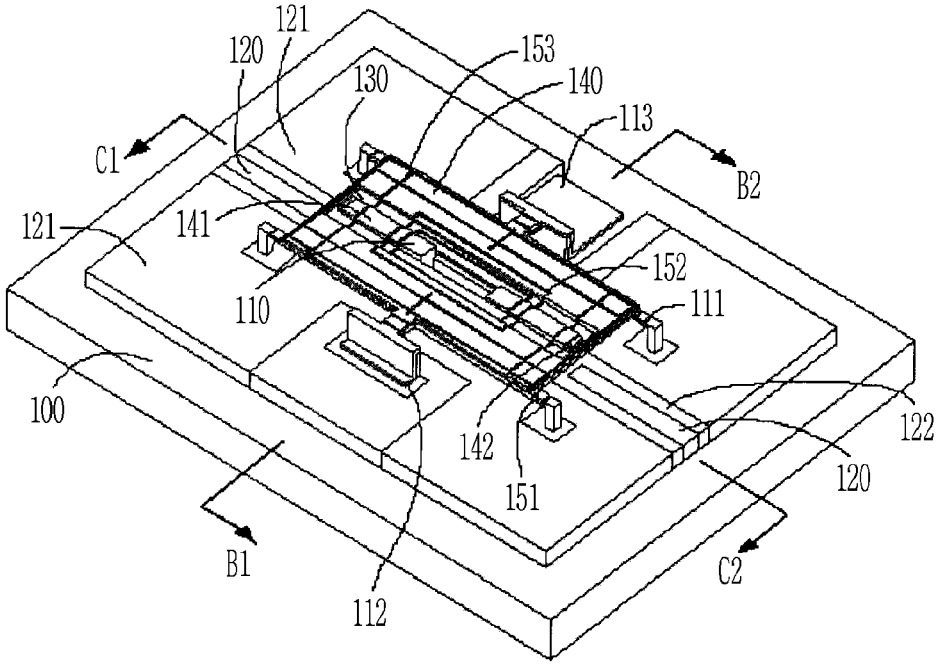
FIG. 4 is a perspective view of a self-sustaining center-anchor microelectromechanical switch according to a preferred embodiment of the present invention.
Figure 5:
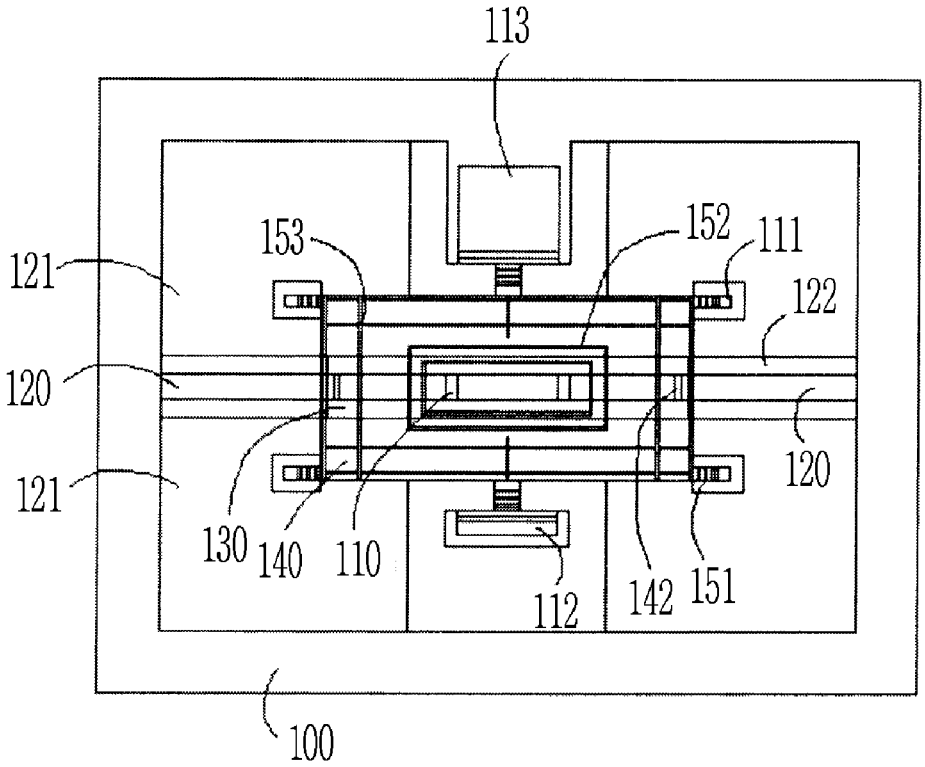
FIGS. 5, 6A and 6B are a plan view and cross-sectional views taken along line B1-B2 and line C1-C2 of FIG. 4, respectively.
Figure 6A:
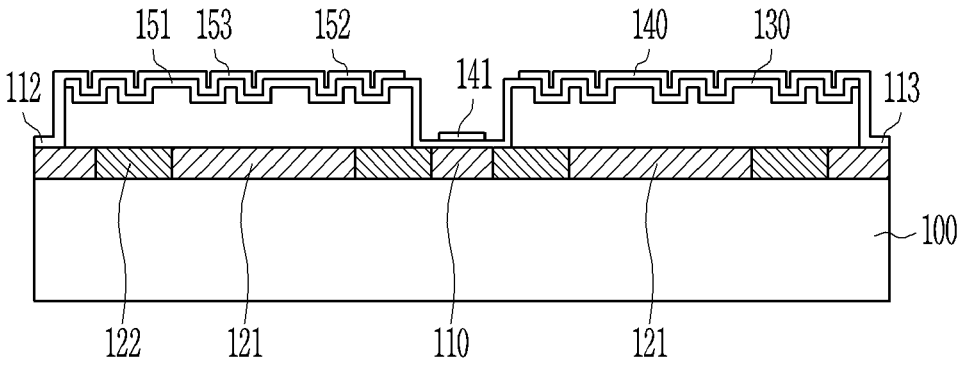
Figure 6B:
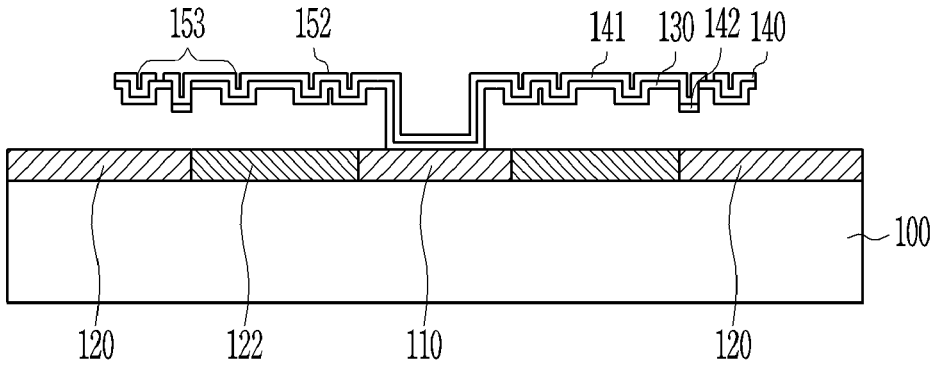

FIG. 4 is a perspective view of a self-sustaining center-anchor microelectromechanical switch according to a preferred embodiment of the present invention, and FIGS. 5, 6A and 6B are a plan view and cross-sectional views taken along line B1-B2 and line C1-C2 of FIG. 4, respectively.

Referring to FIG. 4, an input portion of transmission line 120 and an output portion of transmission line 120 are formed on a semiconductor substrate or a dielectric substrate 100, at a predetermined gap, and an insulating material 122 is formed at both sides of the transmission lines 120 to fabricate parallel dielectric-moving plates 130, and ground lines 121 are formed at both sides of the insulating material 122.

The input portion and the output portion transmission line 120 are spaced apart with a constant distance with a self-sustaining center-anchor 110 therebetween. On upper portions of both sides of the transmission line 120, an upper electrode 140 and a switching unit 141 are formed on the movement plane 130, and a protruded contact metal is formed at both ends of the switching unit 141. The upper electrode 140 and the switching unit 141 are bended downward to connect the transmission lines each other.

Electrode anchors 112, 113 are formed at both sides of the transmission line 120 centering the self-sustaining center-anchor 110, and to support the dielectric-moving plate 130, an edge-anchor 111 is formed at an edge of the movement plane. A corrugated pattern 151 is formed between the edge-anchor 111 and the dielectric-moving plate 130 so that the dielectric-moving plate 130 can operate in a relatively low operating voltage, and a rectangular pattern 152 corresponding to the corrugated pattern 151 is formed between the self-sustaining center-anchor 110 and the dielectric-moving plate 130. A checked pattern 153 is formed between the corrugated pattern 151 and the rectangular pattern 152 so that the dielectric-moving plate 130 can be strong to thermal deformation and make a uniform upward/downward movement. The self-sustaining center-anchor 110 also plays a role in suppressing the thermal deformation of the dielectric-moving plate 130 generated during manufacturing and operation process. The edge-anchors 111 also play a role in suppressing the thermal deformation.

In order for the dielectric-moving plate 130 to operate in a relatively low operating voltage by an electrostatic force between the upper electrode 140 and the ground line 121, it is desirable to insert the corrugated pattern between the edge-anchor 111 and the dielectric-moving plate 130. Further, it is desirable that the rectangular pattern corresponding to the corrugated pattern is inserted between the self-sustaining center-anchor and the dielectric-moving plate.

When the dielectric-moving plate 130 is operated by the electrostatic force, in order that the entire dielectric-moving plate 130 is strong to thermal deformation and makes a uniform upward/downward movement, it is desirable to insert the checked pattern in the dielectric-moving plate 130.

The operation of the foregoing embodiment will now be described in detail with reference to the accompanying drawings. When a predetermined DC driving voltage is applied to the upper electrode 140 and the ground line 121 for switch operation, the electrostatic force is generated in a driving area where the upper electrode 140 and the ground line 121 are overlapped. Thus, by the electrostatic force, an attractive force is generated between the upper electrode 140 and an RF ground line 121, and since the ground line 121 is fixed to the substrate 100, the dielectric-moving plate 130 having elasticity is bended toward the ground line 121, and such a bending of the movement plane 130 causes a contact metal 142 of the switching unit 141 to connect two transmission lines 120 which have been disconnected and thus a signal flows through the transmission line 120. At this time, since there is the dielectric-moving plate 130 between the upper electrode 140 and the ground line 121, a direct electrical contact is not made.

On the contrary, when the predetermined DC driving voltage is removed, due to the restoring force by the spring constant that the dielectric-moving plate 130 has, the contact metal 142 of the switching unit 141 moves upward, thus opening the connection of both sides of the transmission line 120 to block the signal flow.

The signal isolation feature of the switch is determined by the sum of a coupling capacitance value due to the gap between the input and output transmission lines 120 and a coupling capacitance value of the overlapped portion between the transmission lines 120 and the contact metal 142 located at both upper ends of the transmission lines 120. Therefore, in order to obtain a good signal isolation feature, a gap between the input and output transmission lines 120 as well as a gap of the contact metal 142 with respect to the transmission line 120 should be considered.

Since the gap of the transmission lines 120 of the self-sustaining center-anchor 110 microelectromechanical switch can be formed significantly larger than that of a conventional microelectromechanical switch, a relatively superior signal isolation feature can be obtained if the gap of the contact metal 142 with respect to the transmission line 120 is held constant.

The effective spring coefficient of the dielectric-moving plate 130 between the edge-anchor 111 and the self-sustaining center-anchor 110 is relatively larger than that of the conventional microelectromechanical switch without the self-sustaining center-anchor 110. Therefore, the microelectromechanical switch without the self-sustaining center-anchor 110 in the prior art can operate the switch with a lower driving voltage.

However, in the microelectromechanical switch according to the prior art, since the dielectric-moving plate is fixed at both sides while not supported at the center portion, it is sensitive to the thermal deformation between the dielectric layer and the metal layer, and the distance between the dielectric-moving plate and the ground line can be reduced, so that a stiction problem that an upper electrode is adhered to the other fixing element can be easily generated. Such the stiction problem occurs due to the existence of the particles made during the manufacturing process or the moisture between the movement plane and the substrate sustained with the gap of several micrometers, and it acts as a factor that makes a dynamic feature of the switch unstable.

Therefore, the self-sustaining center-anchor 110 is inserted at the center of the dielectric-moving plate 130 in order to prevent the stiction and perform a stable operation while maintaining a constant operating voltage, and the corrugated pattern 151 is inserted that makes the effective spring constant between the edge-anchor 111 and the dielectric movement frame 130 lowered, and the corresponding rectangular pattern 152 is inserted between the dielectric-moving plate 130 and the self-sustaining center-anchor 110.

Further, the checked pattern 153 is inserted between the corrugated pattern 151 and the rectangular pattern 152 so that the dielectric-moving plate 130 can be strong to thermal deformation and make a uniform upward/downward movement.

The shape of the dielectric-moving plate 130 can be used with a variety of modification. Further, the above embodiment describes a single pole single throw (SPST) consisting of one input transmission line and one output transmission line, but it is apparent that the embodiment can also be applied by expanding to a single pole multi throw (SPMT) that has one transmission line and two or more output signal lines.

Next, FIGS. 7A to 7G are cross-sectional views illustrating a method of manufacturing a self-sustaining center-anchor microelectromechanical switch according to an embodiment of the present invention. In FIGS. 7A to 7G are schematic cross-sectional views taken along line C1-C2 of FIG. 4. Referring to FIGS. 4, 5, 6A, 6B, 7A to 7G, a method of manufacturing the self-sustaining center-anchor microelectromechanical switch according to the embodiment of the present invention will now be described.

Figure 7A:
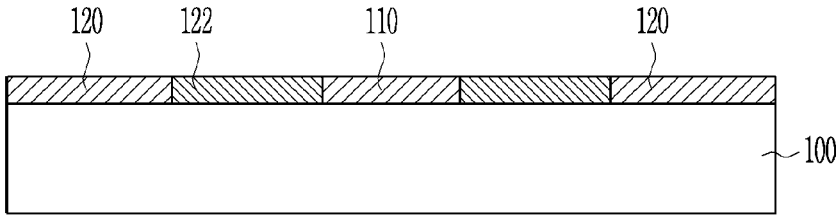
FIGS. 7A to 7G are schematic cross-sectional views taken along line C1-C2 of FIG. 4.

Referring to FIG. 7A, an insulating material 122 is formed in a thickness of 1 μm on the substrate 100, and a pattern is formed by a Reactive Ion Etching (RIE) method or a wet etching method using a predetermined mask after depositing a photoresist material. The transmission line 120, the ground line 121 and self-sustaining center-anchor 110 are formed with a thickness of 1 μm on the removed portion by a thin film deposition process and a lift-off process. Further, the ground lines 121 are formed at both sides of the insulating material 122. Meanwhile, the transmission line 120 formed in the center is connected to the input portion and the output portion, respectively, thus being formed in a disconnected shape at the switching unit 141, and the transmission line 120 and the ground line 121 of FIG. 6A can be formed of a noble metal, such as Au.

Figure 7B:
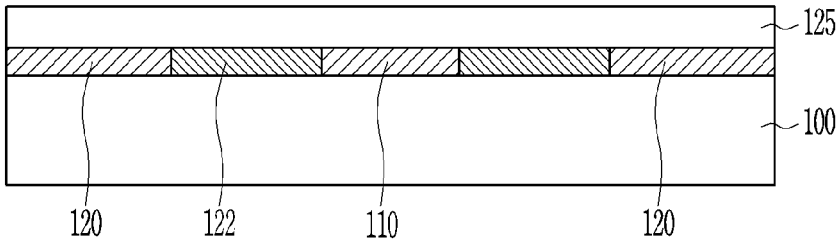

Referring to FIG. 7B, after depositing the sacrificial layer 125 of 2 μm thickness on the entire structure, predetermined regions are patterned to support the dielectric-moving plate 130 via a reactive ion etching (RIE) method or a wet etching method using a predetermined mask after depositing a photoresist.

Figure 7C:
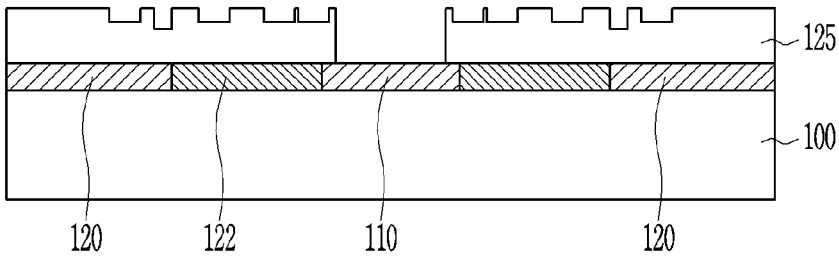

Referring to FIG. 7C, 0.2 μm thick pattern is formed by an RIE method or a wet etching method using a predetermined mask after depositing a photoresist, in order to form the corrugated pattern, the rectangular pattern and the checked pattern of the dielectric-moving plate 130 that connect each anchor 110, 111, 112 and 113.

Figure 7D:
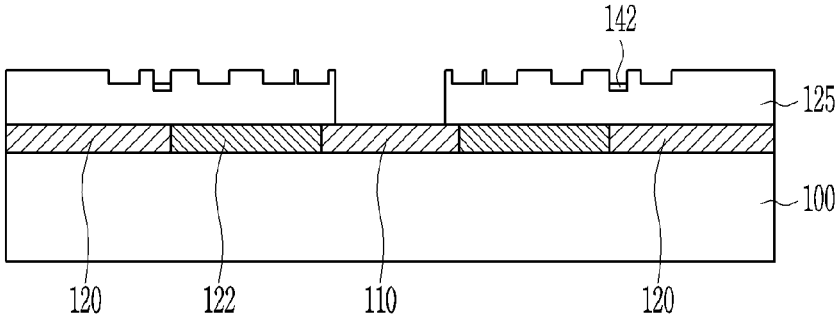

Referring to FIG. 7D, the contact metal 142 is formed on the sacrificial layer 125 by depositing the photoresist, patterning it with a thickness of about 0.3 μm by means of RIE or wet etching using the predetermined mask, performing thin film deposition with a thickness of about 0.3 μm, and performing a lift-off process.

Figure 7E:
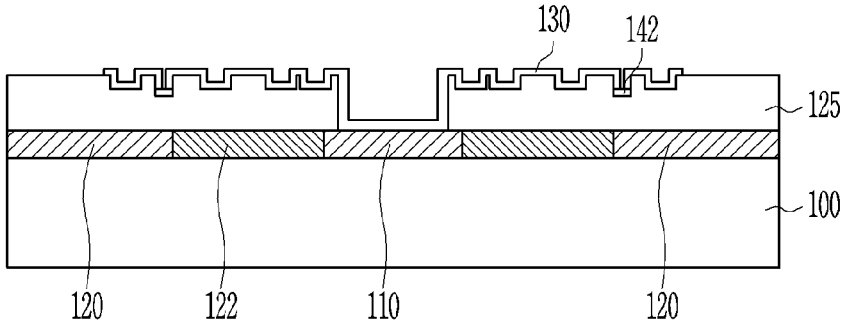

As shown in FIG. 7E, the dielectric-moving plate 130 is formed that is supported by the anchors 110, 111, 112, 113 and allows the transmission line 120 and the ground line 121 to be vertically spaced apart with a given distance from the switching unit 141 and the upper electrode 140. In this case, a silicon nitride layer is formed in a thickness of 0.4 μm by a plasma enhanced chemical vapor deposition (PECVD) method and the dielectric-moving plate 130 is patterned.

Figure 7F:
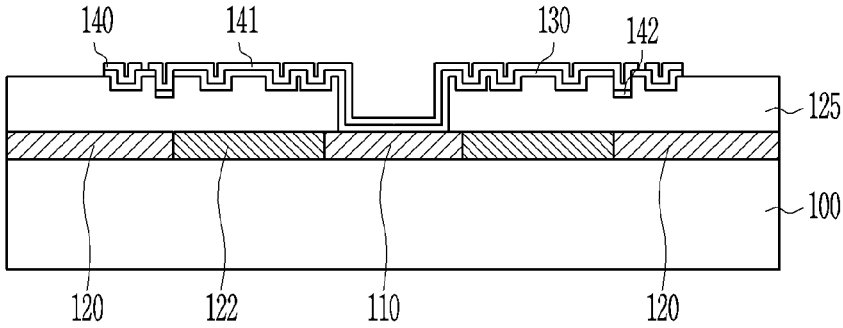

Referring to FIG. 7F, the switching unit 141 is formed on the dielectric-moving plate 130 to match with the end portion of the transmission line 120, and at the same time, the upper electrodes 140 are formed at both sides of the switching unit 141, respectively. The switching unit 141 and the upper electrode 140 are formed by a metal thin film deposition and a lift-off processes.

Figure 7G:
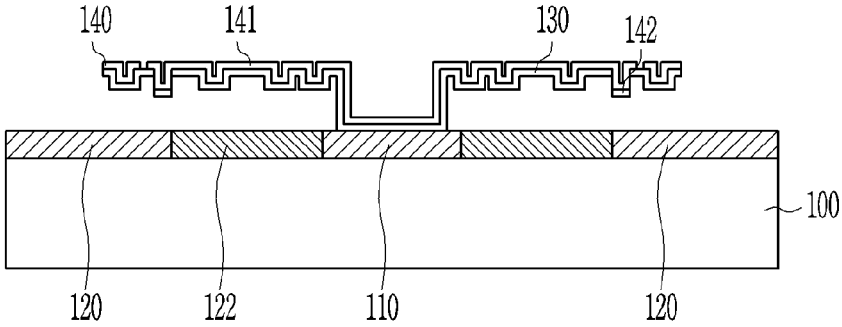

Referring to FIG. 7G, the sacrificial layer 125 is removed by an RIE method or a wet etching method.

Figure 8:
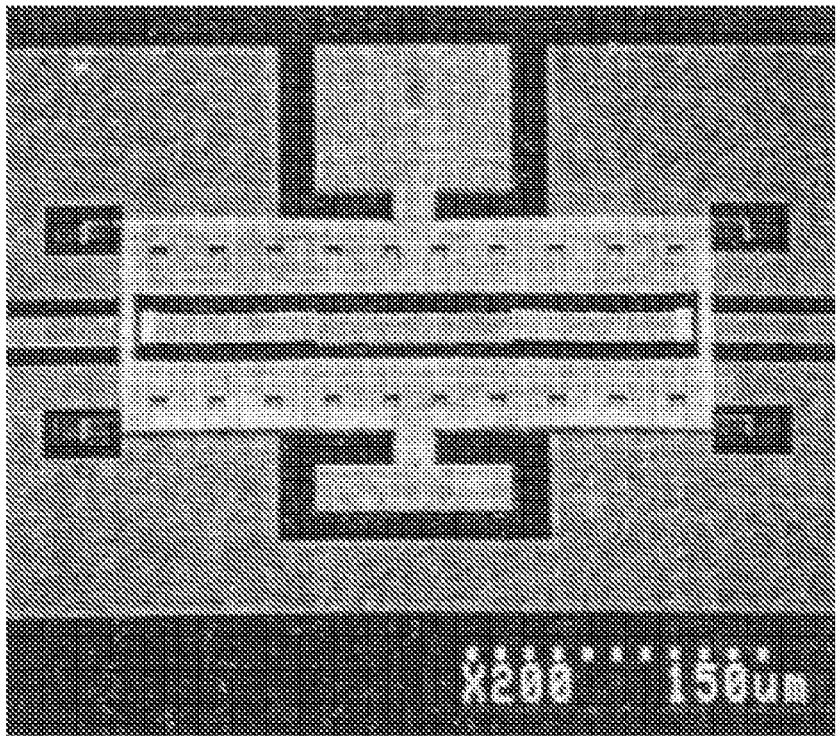
FIG. 8 is a scanning electron microscope picture of an actually manufactured self-sustaining center-anchor microelectromechanical switch of the present invention.

FIG. 8 is a scanning electron microscope picture of an actually manufactured self-sustaining center-anchor microelectromechanical switch of the present invention. However, in FIG. 8, the shape of the dielectric-moving plate is a bit differently configured with that of FIG. 4.

Figure 9:
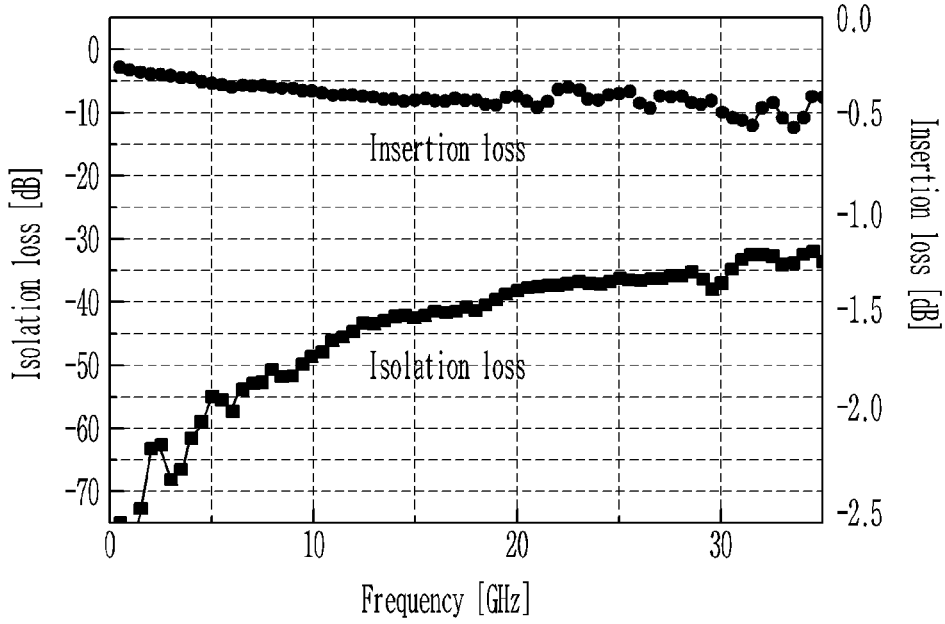
FIG. 9 is a graph showing an RF characteristic value that is measured with a sample of an actually manufactured self-sustaining center-anchor microelectromechanical switch.

FIG. 9 is a graph showing an RF characteristic value that is measured with the HP8510 network analyzer, RF measuring equipment, in a frequency range of 0.5 to 35 GHz, using a sample of a self-sustaining center-anchor microelectromechanical switch manufactured in a manner described above.

Referring to FIG. 9, at a frequency of 20 GHz, the insertion loss is −0.38 dB, a signal isolation feature −38 dB, which show an extremely superior RF characteristic value where the signal isolation feature is improved about 10 to 15 dB while the insertion loss maintains performance of the existing microelectromechanical switch.

Therefore, according to the present invention, a microelectromechanical switch having good reliability can be obtained that is less sensitive to the thermal deformation during manufacturing and operation process, and makes a stable contact between the contact metal and the transmission line, thus achieving improved insertion loss and signal isolation feature, and making a stable operation.

The above embodiments are provided for thorough understanding of the present invention to those skilled in the art, which a variety of modification can be made. The scope of the present invention is, however, not limited to foregoing embodiments.

As illustrated above, according to the present invention, a self-sustaining center-anchor can be obtained that improves the structural feature of the conventional cantilever or membrane type. Since the contact unit of the contact metal is located in the same direction as the transmission line, the self-sustaining center-anchor microelectromechanical switch of the present invention is less sensitive to the thermal deformation generated during manufacturing and operation process, and can improve the ground line contact phenomenon of the upper electrode by the self-sustaining center-anchor, thereby being operated as a more stable switch, and significantly improves the signal isolation feature while maintaining the existing insertion loss feature since the signal line gap is extremely larger than that of the microelectromechanical switch according to the prior art.

What is claimed is:

1. A method of manufacturing a self-sustaining center-anchor microelectromechanical switch, the method comprising the steps of:

after forming a thin film on a substrate with an insulating material, patterning the thin film using a predetermined mask;

forming transmission lines and ground lines in a patterned portion;

depositing and patterning a sacrificial layer on the transmission lines and the ground lines to form a self-sustaining center-anchor;

forming a switching unit made of a metal that electrically connects the transmission lines on the sacrificial layer during short-circuit operation;

forming a dielectric-moving plate that allows the transmission lines and the ground lines to be spaced apart with a constant gap by a plurality of electrode and edge-anchors to the switching unit and an upper electrode;

forming the upper electrodes that act as a driving electrode to the ground line on the dielectric-moving plate; and removing the sacrificial layer formed between the dielectric-moving plate and the transmission line.

2. The method of claim 1, wherein, while forming the transmission lines, the transmission line is inserted between an input portion transmission line and an output portion transmission line to form the self-sustaining center-anchor.

3. The method of claim 1, wherein, when forming the ground lines, edge-anchors insulated with the ground lines for forming the edge-anchors are formed within the ground lines.

4. The method of claim 1, wherein, after depositing the sacrificial layer, the self-sustaining center-anchor is formed in the same direction as that of a transmission signal flow.

5. The method of claim 1, wherein, after depositing the sacrificial layer, edge-anchors are formed at edge portions of the dielectric-moving plate.

6. The method of claim 1, wherein, after depositing the sacrificial layer, electrode anchors are formed to provide an electrostatic force at both sides of the dielectric-moving plate.

7. The method of claim 1, wherein the edge-anchors and the dielectric-moving plate have a connecting portion for connecting with each other on the sacrificial layer, the connecting portion being provided with corrugated patterns.

8. The method of claim 1, wherein the self-sustaining center-anchor and the dielectric-moving plate have a connecting portion for connecting with each other on the sacrificial layer, the connecting portion being provided with rectangular patterns.

9. The method of claim 1, wherein the electrode anchors and the dielectric-moving plate have a connecting portion for connecting with each other on the sacrificial layer, the connecting portion being provided with checked patterns.

* * * * *